US009454953B2

(12) United States Patent
Yano

(10) Patent No.: US 9,454,953 B2
(45) Date of Patent: Sep. 27, 2016

(54) ACTIVE VIBRATION/NOISE CONTROL APPARATUS

(71) Applicant: Atsuyoshi Yano, Chiyoda-ku (JP)

(72) Inventor: Atsuyoshi Yano, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/760,061

(22) PCT Filed: Feb. 20, 2013

(86) PCT No.: PCT/JP2013/054150
§ 371 (c)(1),
(2) Date: Jul. 9, 2015

(87) PCT Pub. No.: WO2014/128857
PCT Pub. Date: Aug. 28, 2014

(65) Prior Publication Data

US 2016/0012815 A1 Jan. 14, 2016

(51) Int. Cl.
*G10K 11/178* (2006.01)

(52) U.S. Cl.
CPC ..... *G10K 11/178* (2013.01); *G10K 11/1788* (2013.01); *G10K 2210/121* (2013.01); *G10K 2210/1291* (2013.01); *G10K 2210/3028* (2013.01); *G10K 2210/30391* (2013.01); *G10K 2210/503* (2013.01)

(58) Field of Classification Search
None
See application file for complete search history.

(56) References Cited

U.S. PATENT DOCUMENTS

2011/0222698 A1* 9/2011 Asao ..... G10K 11/1784 381/71.1
2011/0305347 A1* 12/2011 Wurm ..... G10K 11/178 381/71.1
2014/0032044 A1* 1/2014 Watai ..... G05D 19/02 701/36

FOREIGN PATENT DOCUMENTS

JP 03-178845 A 8/1991
JP 04-011536 A 1/1992
JP 05-307393 A 11/1993
JP 07-219563 A 8/1995
JP 08-339192 A 12/1996
JP 2009-241672 A 10/2009

OTHER PUBLICATIONS

U.S. Appl. No. 14/759,303, filed Jul. 6, 2015, Yano.
International Search Report issued May 28, 2013, in PCT/JP2013/054150, filed Feb. 20, 2013.

* cited by examiner

*Primary Examiner* — Paul Huber
(74) *Attorney, Agent, or Firm* — Oblon, McClelland, Maier & Neustadt, L.L.P

(57) ABSTRACT

A control signal filter 2 receives a sound source signal determined by a control frequency specified in accordance with the vibration/noise source that produces vibration/noise, and outputs a control signal. A filter coefficient update unit 4 updates coefficients of the control signal filter 2 in response to a sound source signal and an error signal. A disturbance detector 6 outputs a disturbance detection result in response to the error signal and an estimated secondary vibration/noise signal. An update controller 7 adjusts an update step of the filter coefficient update unit 4 in accordance with the disturbance detection result.

6 Claims, 3 Drawing Sheets

ACTIVE VIBRATION/NOISE CONTROL APPARATUS

TECHNICAL FIELD

The present invention relates to an active vibration/noise control apparatus for reducing vibration or noise produced by machinery, for example, by generating cancellation vibration or noise.

BACKGROUND ART

As a means for reducing vibration or noise which machinery produces, an active vibration control apparatus and an active noise control apparatus are known. Since the present invention is applicable to both of them, the instant specification refers to them as an active vibration/noise control apparatus collectively which means an "apparatus for controlling vibration or noise". Likewise, as for "vibration or noise" of machinery, they are referred to as vibration/noise collectively.

A conventional active vibration/noise control apparatus detects vibration or noise, which is a controlled subject, with a detector such as a vibration sensor or microphone, and controls it by outputting the same amplitude and anti-phase control signal for cancellation. As an example of such an active vibration/noise control apparatus, Patent Document 1, for example, discloses an active noise/vibration control apparatus that uses an adaptive notch filter. Here, if disturbance unrelated to the controlled subject is provided to the detector, the apparatus responds to it, and offers a problem of deviating the amplitude and phase of the control signal, thereby reducing suppression effect, or a problem of the apparatus itself of producing extraordinary vibration or a strange sound. As a concrete example of such disturbance, there is an impact or the sound of the impact caused by contact of a person or object with the vibration sensor, microphone or the body of the apparatus, or external sounds unrelated to the vibration/noise such as human voices input to the microphone.

Regarding such a problem, Patent Document 2, for example, discloses a method which decides, if the amplitude and the rate of change of the amplitude of the noise signal detected with the detector exceed a prescribed threshold, that it is an extraordinary input, that is, the disturbance, and suppresses the change of the control signal.

PRIOR ART DOCUMENT

Patent Document

Patent Document 1: Japanese Patent Laid-Open No. 8-339192.

Patent Document 2: Japanese Patent Laid-Open No. 2009-241672.

DISCLOSURE OF THE INVENTION

Problems to be Solved by the Invention

However, as for the method of the foregoing Patent Document 2, since the detector detects the vibration/noise after the suppression according to the operation of the active vibration/noise apparatus, and the method detects the disturbance in response to the signal detected, it has a problem of temporarily weakening the suppression effect of the vibration/noise owing to erroneous adaptation of the active vibration/noise apparatus, for example, and a problem of deciding an increase in the vibration/noise detected as disturbance erroneously, and thus further reducing the noise suppression effect by stopping the adaptive operation.

In addition, when the active vibration/noise control apparatus achieves sufficient suppression effect, the vibration/noise observed by the detector attenuates, and the disturbance other than the vibration/noise appears to be increased. In these circumstances, since it seems that comparatively large disturbance occurs against the vibration/noise, determining a threshold using the observed vibration/noise with the detector as a reference and trying to detect the extraordinary input using the threshold offers a problem of detecting small disturbance which has only a small effect originally as an extraordinary input, and a problem of reducing the effect of the active vibration/noise control apparatus.

The present invention is implemented to solve the foregoing problems. Therefore it is an object of the present invention to provide an active vibration/noise control apparatus capable of distinguishing, even when the suppression effect of the active vibration/noise control apparatus reduces temporarily and the vibration/noise observed by the detector increases, the vibration/noise from the extraordinary input, thereby offering a stable vibration/noise suppression effect. Another object of the present invention is to provide, even in the case where the vibration/noise is sufficiently suppressed by the operation of the active vibration/noise control apparatus and thus the disturbance appears to become greater than the vibration/noise, an active vibration/noise control apparatus capable of neglecting the disturbance with a small effect and capable of detecting only the disturbance accurately that will affect the operation of the apparatus.

Means for Solving the Problems

An active vibration/noise control apparatus in accordance with the present invention comprises: a control signal filter that receives a sound source signal determined by control frequency specified in accordance with a vibration/noise source which produces vibration/noise, and that outputs a control signal; a filter coefficient updater that updates coefficients of the control signal filter in response to an error signal and the sound source signal, the error signal resulting from interference of the vibration/noise with secondary vibration/noise generated from the control signal; a secondary vibration/noise estimator that outputs an estimated secondary vibration/noise signal in response to the control signal; a disturbance detector that outputs a disturbance detection result in response to the error signal and the estimated secondary vibration/noise signal; and an update controller that adjusts an update step of the filter coefficient updater in response to the disturbance detection result.

Advantages of the Invention

The active vibration/noise control apparatus in accordance with the present invention adjusts the update step of the filter coefficient update unit in accordance with the disturbance detection result calculated from the error signal and estimated secondary vibration/noise signal. Accordingly, even if the residual vibration/noise increases temporarily owing to the erroneous adaptation, it can prevent erroneous detection of it as the disturbance, and achieves a stable vibration/noise reduction effect.

BEST MODE FOR CARRYING OUT THE INVENTION

The best mode for carrying out the invention will now be described with reference to the accompanying drawings to explain the present invention in more detail.

Embodiment 1

Figure 1:
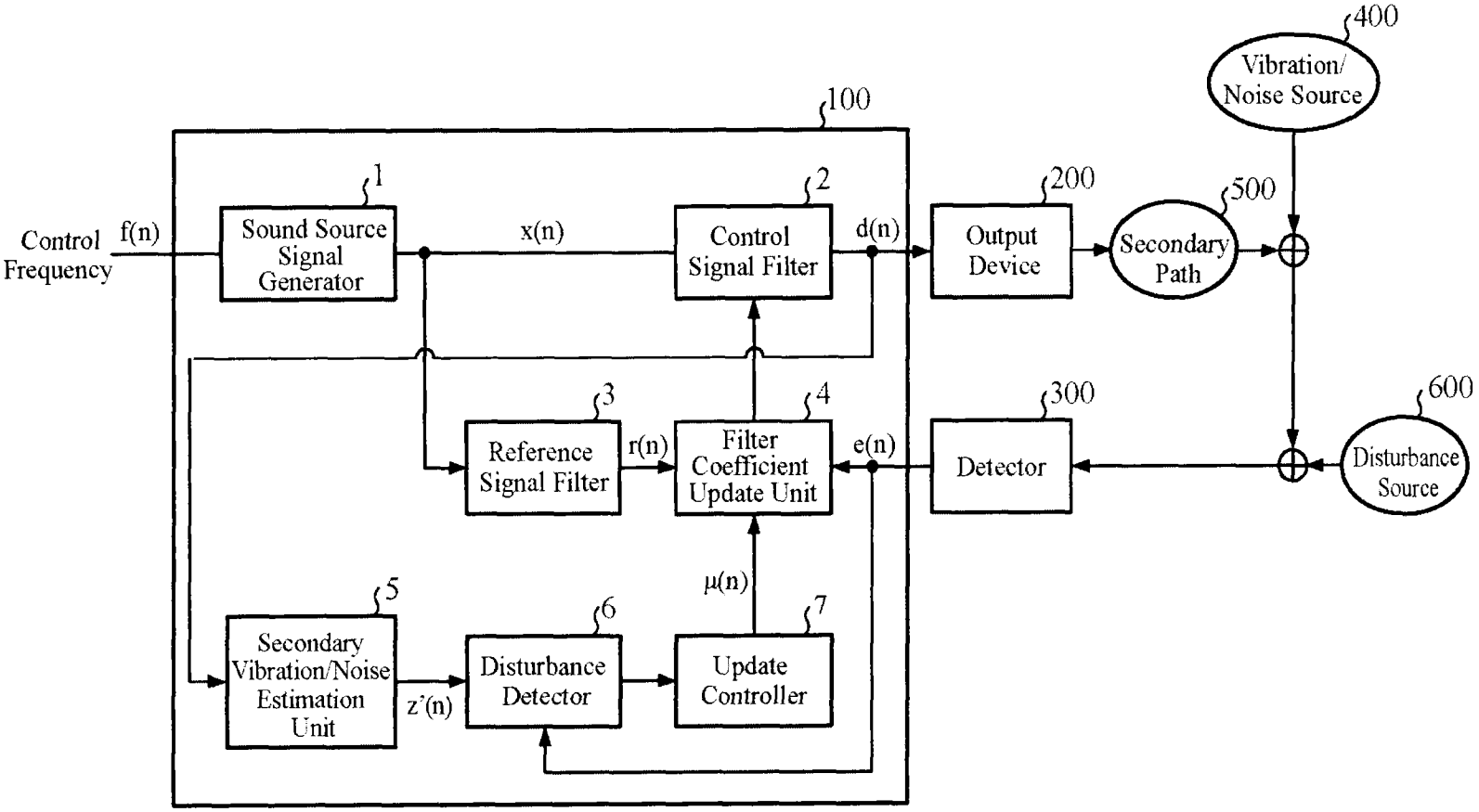
FIG. 1 is a block diagram showing a configuration of an active vibration/noise control apparatus of an embodiment 1 in accordance with the present invention.

FIG. 1 is a block diagram showing a configuration of an active vibration/noise control apparatus of an embodiment 1 in accordance with the present invention.

As shown in FIG. 1, the active vibration/noise control apparatus 100 of the embodiment 1 in accordance with the present invention is connected to an output device 200 and a detector 300, which are placed outside the apparatus.

The active vibration/noise control apparatus 100 receives control frequency based on the frequency of the vibration/noise of a vibration/noise source 400 which is a controlled subject, and outputs a control signal produced in response to the input control frequency. Here, if the vibration/noise source is the engine of a car, for example, the control frequency is obtained by a method that measures the rotational frequency of the engine from an ignition pulse period, followed by making constant times the rotational frequency in accordance with the engine rotational order of the target vibration/noise. In addition, if the vibration/noise source is a fan driven by an electric motor, the frequency of the target NZ noise can be obtained from the number of poles of the motor, the power supply frequency and the number of blades of the fan. In this way, as for the acquisition of the control frequency, a method appropriate to the target vibration/noise source can be used properly.

The output device 200 is one that converts the control signal supplied from the active vibration/noise control apparatus 100 to secondary vibration/noise for canceling the vibration/noise produced from the vibration/noise source 400 and outputs the secondary vibration/noise, and can be implemented by a speaker or an actuator. The secondary vibration/noise produced from the output device 200 is propagated through a secondary path 500, interferes with the vibration/noise produced from the vibration/noise source 400, and reduces the vibration/noise. Here, the secondary path 500 is defined as a path through which the secondary vibration/noise produced from the output device 200 is propagated up to the detector 300. In addition, a disturbance source 600 is one that further adds unspecific disturbance unrelated to the vibration/noise source 400 to the reduced vibration/noise.

The detector 300 is a device that detects an error which is residual vibration/noise produced by the interference between the secondary vibration/noise and the vibration/noise, and supplies the detected error to the active vibration/noise control apparatus 100 as an error signal e(n). It can be implemented by a microphone, a vibration sensor, an acceleration sensor or the like, for example.

Next, a detailed configuration of the active vibration/noise control apparatus 100 will be described. The active vibration/noise control apparatus 100 comprises a sound source signal generator 1, a control signal filter 2, a reference signal filter 3, a filter coefficient update unit 4, a secondary vibration/noise estimation unit 5, a disturbance detector 6 and an update controller 7.

The sound source signal generator 1 is a signal generator that produces the sound source signal in response to the control frequency input to the active vibration/noise control apparatus 100. The sound source signal generator 1 supplies the sound source signal produced to the control signal filter 2.

The control signal filter 2 is a filter that carries out filter processing of the sound source signal from the sound source signal generator 1, and outputs the control signal. Although the details thereof will be described later, the control signal is a signal to be converted to the secondary vibration/noise for reducing the vibration/noise.

The reference signal filter 3 is a filter that outputs the reference signal by carrying out the filter processing of the sound source signal from the sound source signal generator 1 by using the transfer characteristic parameters determined in accordance with the transfer characteristics of the secondary path 500. The reference signal filter 3 supplies the reference signal to the filter coefficient update unit 4.

The filter coefficient update unit 4 updates the filter coefficients of the control signal filter 2 using an adaptive algorithm such as an LMS (Least Mean Square) algorithm in accordance with the reference signal from the reference signal filter 3, the error signal from the detector 300 and the update step provided from the update controller 7 which will be described later.

The secondary vibration/noise estimation unit 5 carries out the filter processing of the control signal from the control signal filter 2 to generate an estimated secondary vibration/noise signal, and supplies it to the disturbance detector 6.

The disturbance detector 6 detects the disturbance in response to the estimated secondary vibration/noise signal from the secondary vibration/noise estimation unit 5 and the error signal from the detector 300, and supplies the update controller 7 with a disturbance detection result.

The update controller 7 determines the update step for updating the filter coefficients in accordance with the disturbance detection result from the disturbance detector 6, and supplies it to the filter coefficient update unit 4.

Next, the operation of the active vibration/noise control apparatus of the embodiment 1 will be described.

First, the control frequency f(n) representing the frequency of the vibration/noise is input to the sound source signal generator 1 in the active vibration/noise control apparatus 100. Here, n is a positive integer that designates the sampling time in the digital signal processing. The sound source signal generator 1 supplies the sound source signal x(n) corresponding to the control frequency f(n) to the control signal filter 2 and the reference signal filter 3.

The control signal filter 2 carries out the filter processing of the sound source signal x(n) by using a control filter coefficient sequence W(n), and outputs the control signal d(n) to the output device 200. Here, the control filter coefficient sequence W(n) is a first-order or higher-order filter coefficient sequence.

The output device 200 converts the control signal d(n) output from the control signal filter 2 to the secondary vibration/noise and outputs it. The secondary vibration/noise output from the output device 200 is propagated through the secondary path 500, is affected by the transfer characteristics of the secondary path 500 during the process, and interferes with the vibration/noise produced from the vibration/noise source 400, thereby reducing the vibration/noise.

The reduced vibration/noise further receives the disturbance from the disturbance source 600.

The detector 300 detects the vibration/noise passing through the reduction followed by the addition of the disturbance, that is, the sum of the vibration/noise and the secondary vibration/noise and the disturbance, or the error containing disturbance, which is the addition of the residual vibration/noise and the disturbance, and generates the error signal e(n). Here, the error signal e(n) is the sum of the vibration/noise y(n) which is produced by the vibration/noise source 400 and reaches the detector 300, the secondary vibration/noise z(n) for canceling the vibration/noise, which is produced from the output device 200 in response to the control signal d(n) and reaches the detector 300 via the secondary path 500, and the disturbance v(n) the disturbance source 600 produces, and is given by the following Expression (1).

$$e(n)=y(n)+z(n)+v(n) \tag{1}$$

Incidentally, in Expression (1), y(n)+z(n) corresponds to the residual vibration/noise that is left after the cancellation. Replacing it by the residual vibration/noise s(n) yields the following Expression (2).

$$s(n)=y(n)+z(n) \tag{2}$$

The error signal e(n) produced by the detector 300 is input to the filter coefficient update unit 4 in the active vibration/noise control apparatus 100.

In addition, the reference signal filter 3 carries out the filter processing of the sound source signal x(n) output from the sound source signal generator 1 using the reference filter coefficient sequence C with the transfer characteristics of the secondary path 500, and outputs the reference signal r(n). Here, the reference filter coefficient sequence C is a first-order or higher-order filter coefficient sequence.

In response to the reference signal r(n) output from the reference signal filter 3, the error signal e(n) output from the detector 300, and the update step p(n) from the update controller 7, the filter coefficient update unit 4 sequentially updates the value of the control filter coefficient sequence W(n) of the control signal filter 2 so as to reduce the residual vibration/noise included in the error signal e(n).

The secondary vibration/noise estimation unit 5 generates the estimated secondary vibration/noise signal z'(n) through the filter processing of the control signal d(n) using the reference filter coefficient sequence C with the transfer characteristics of the secondary path 500. As described before, since the control signal d(n) passes from the output device 200 to the detector 300 via the secondary path 500 to form the secondary vibration/noise z(n), the estimated secondary vibration/noise signal z'(n) resulting from carrying out the filter processing of the control signal d(n) by using the reference filter coefficient sequence C with the transfer characteristics of the secondary path 500 becomes an estimated signal of the secondary vibration/noise z(n).

The disturbance detector 6 detects the presence or absence of the disturbance that will prevent the adaptive operation of the filter coefficient update unit 4 in response to the error signal e(n) and the estimated secondary vibration/noise signal z'(n). At this time, the disturbance detector 6 subtracts the estimated secondary vibration/noise signal z'(n) from the error signal e(n), and obtains an estimated original detection signal w(n).

$$w(n)=e(n)-z'(n)\approx y(n)+v(n) \tag{3}$$

The disturbance detector 6 analyzes the estimated original detection signal w(n) given by Expression (3), detects the presence or absence of the disturbance that will prevent the adaptive operation of the filter coefficient update unit 4, and outputs the disturbance detection result. As for a detection method of the disturbance, it is known, and a method such as described in the Patent Document 2 can be used, for example.

Here, the estimated original detection signal w(n) is a signal that estimates the state before the secondary vibration/noise z(n) cancels the vibration/noise y(n), and is determined only by the vibration/noise y(n) and the disturbance v(n) regardless of the suppression operation of the vibration/noise by the active vibration/noise control apparatus 100. Accordingly, even in such a case where the residual vibration/noise s(n) increases temporarily owing to the erroneous adaptation of the filter coefficient update unit 4, the estimated original detection signal w(n) is not affected by that. As a result, even in the case where the residual vibration/noise s(n) increases temporarily owing to the erroneous adaptation of the filter coefficient update unit 4 or the like, detecting the disturbance in response to the estimated original detection signal w(n) enables preventing the disturbance from being erroneously detected as disturbance.

In addition, even in a case where the residual vibration/noise s(n) reduces because the active vibration/noise control apparatus 100 operates well, and the disturbance v(n) is observed to be apparently large with respect to the error signal e(n), since the vibration/noise y(n) and the disturbance v(n) are contained in the estimated original detection signal w(n) in their original ratio, detecting the disturbance in response to the signal w(n) will enable neglecting trivial disturbance that will not hinder the adaptive operation of the coefficient update unit 104.

The update controller 7 determines the update step of the filter coefficient update unit 4 in accordance with the disturbance detection result of the disturbance detector 6. For example, unless the disturbance detection result indicates the presence of the disturbance, it determines the update step at a prescribed update step, but if it indicates the presence thereof, a method is conceivable which prevents erroneous adaptation by making the update step zero. Alternatively, it is also possible to decrease the update step by step in accordance with the magnitude of the disturbance detected.

As described above, according to the active vibration/noise control apparatus of the embodiment 1, it comprises: the control signal filter that receives the sound source signal determined by the control frequency specified in accordance with the vibration/noise source that produces the vibration/noise, and outputs the control signal; the filter coefficient update unit that updates the coefficients of the control signal filter in response to the error signal and the sound source signal, the error signal resulting from the interference of the vibration/noise with the secondary vibration/noise generated from the control signal; the secondary vibration/noise estimation unit that outputs the estimated secondary vibration/noise signal in response to the control signal; the disturbance detector that outputs the disturbance detection result in response to the error signal and the estimated secondary vibration/noise signal; and the update controller that adjusts the update step of the filter coefficient update unit in response to the disturbance detection result. Accordingly, even in the case where the residual vibration/noise increases temporarily owing to the erroneous adaptation or the like, it can prevent the residual vibration/noise from being erroneous detected as the disturbance, thereby offering an advantage of being able to achieve the stable vibration/noise reduction effect. In addition, even in the case where the residual vibration/noise reduces owing to the operation of the active vibration/noise control apparatus and the disturbance is observed to be apparently large in the error signal, it can prevent the excessive detection of the trivial disturbance that will not hinder the adaptive operation, thereby being able to achieve the stable vibration/noise reduction effect.

In addition, according to the active vibration/noise control apparatus of the embodiment 1, since the secondary vibration/noise estimation unit processes the control signal through the filter with the transfer characteristics of the secondary path through which the secondary vibration/noise is propagated, and outputs the estimated secondary vibration/noise signal, even when the residual vibration/noise increases temporarily owing to the erroneous adaptation or the like, it can prevent the erroneous detection of the residual vibration/noise as the disturbance, thereby offering an advantage of being able to achieve the stable vibration/noise reduction effect.

In addition, according to the active vibration/noise control apparatus of the embodiment 1, since the disturbance detector is configured in such a manner as to output the disturbance detection result in response to the estimated original detection signal obtained by subtracting the estimated secondary vibration/noise from the error signal, even when the residual vibration/noise increases temporarily owing to the erroneous adaptation or the like, it can prevent the erroneous detection of the residual vibration/noise as the disturbance, thereby offering an advantage of being able to achieve the stable vibration/noise reduction effect.

Embodiment 2

The foregoing active vibration/noise control apparatus of the embodiment 1 detects the disturbance from the estimated secondary vibration/noise signal obtained by the filter processing of the control signal using the reference filter coefficient sequence. On the other hand, a configuration is also possible which uses an adaptive notch filter instead as the secondary vibration/noise estimation unit of the active noise control apparatus to estimate the amplitude and phase of the secondary vibration/noise from the gain characteristics and phase characteristics of the control signal filter and the reference signal filter, and to detect the disturbance from the estimated secondary vibration information obtained, which enables reducing the amount of calculation of the signal processor. A configuration in such a case will be described as an embodiment 2 in accordance with the present invention.

Figure 2:
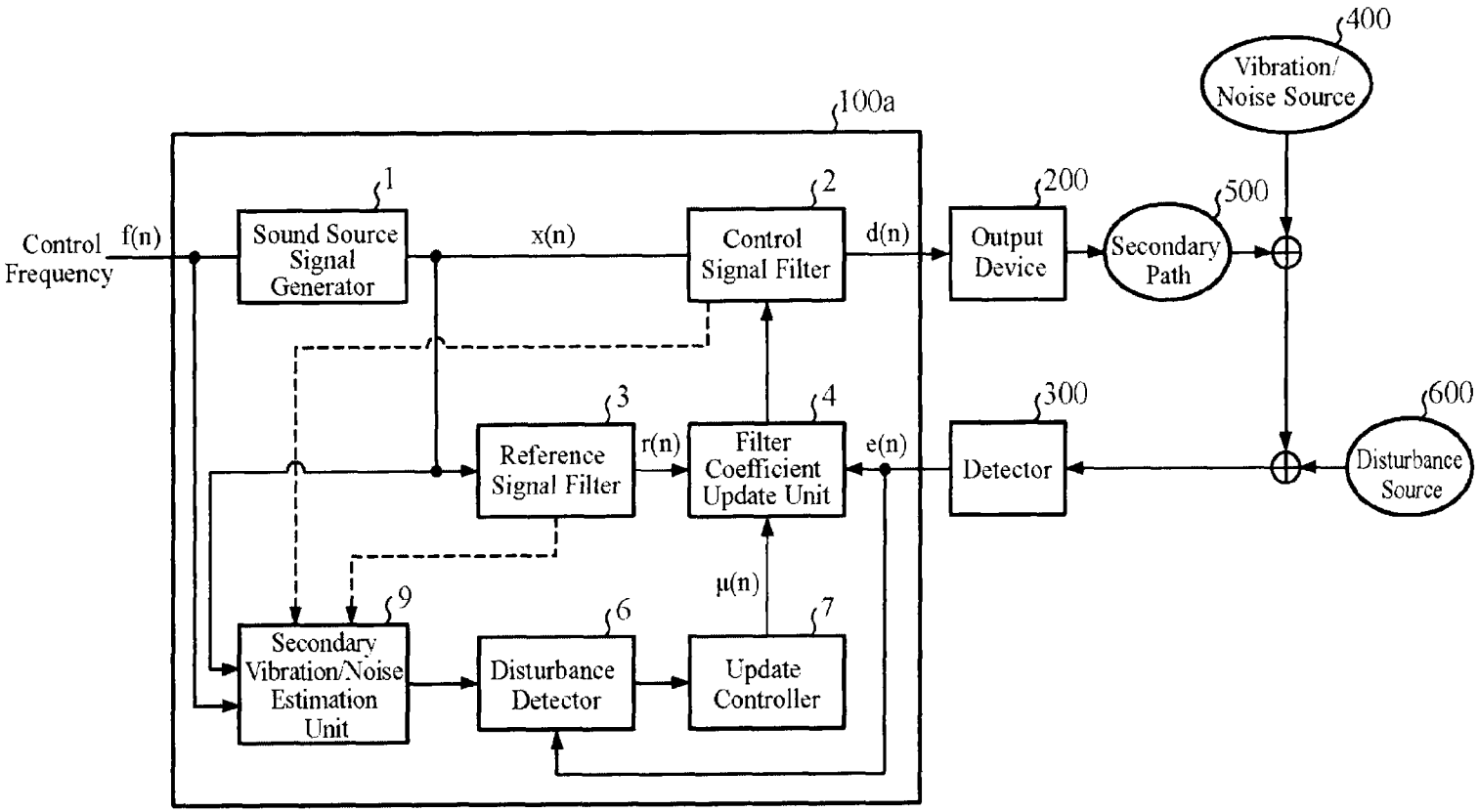
FIG. 2 is a block diagram showing a configuration of an active vibration/noise control apparatus of an embodiment 2 in accordance with the present invention.

FIG. 2 is a block diagram showing a configuration of the active vibration/noise control apparatus of the embodiment 2.

As shown in FIG. 2, the active vibration/noise control apparatus 100*a* of the embodiment 2 in accordance with the present invention comprises the sound source signal generator 1, the control signal filter 2, the reference signal filter 3, the filter coefficient update unit 4, the disturbance detector 6, the update controller 7, and a secondary vibration/noise estimation unit 9. Among them, since the same components as those of the embodiment 1 are designated by the same reference numerals of FIG. 1, their description will be omitted. However, since the embodiment 2 in accordance with the present invention uses an adaptive notch filter for the adaptive control of the vibration/noise, description of relevant portions will be added.

The secondary vibration/noise estimation unit 9 of the embodiment 2 generates the estimated secondary vibration/noise signal from the control frequency provided to the active vibration/noise control apparatus 100*a*, the sound source signal from the sound source signal generator 1, the control filter coefficient sequence of the control signal filter 2, and the reference filter coefficient sequence of the reference signal filter 3, and supplies it to the disturbance detector 6.

Next, the operation of the active vibration/noise control apparatus of the embodiment 2 will be described.

The sound source signal generator 1 outputs two types of signals, cosine signal $x_0(n)$ and sine signal $x_1(n)$, in response to the control frequency f(n) as the sound source signal.

The control filter coefficient sequence W(n) of the control signal filter 2 is comprised of a first control filter coefficient $w_0(n)$ and a second control filter coefficient $w_1(n)$, and the control signal filter 2 multiplies the cosine signal $x_0(n)$ by the first control filter coefficient $w_0(n)$ and the sine signal $x_1(n)$ by the second control filter coefficient $w_1(n)$, adds them and outputs the addition result as the control signal d(n).

$$d(n)=w_0(n)x_0(n)+w_1(n)x_1(n) \tag{4}$$

As for the reference filter coefficient sequence C of the reference signal filter 3, it holds the coefficients reflecting the transfer characteristics of the secondary path 500 for arbitrary frequency f. More specifically, assuming that the secondary path 500 has gain characteristics A(f) and phase characteristics θ(f) at frequency f, the first reference filter coefficient $c_0$ (f) and the second reference filter coefficient $c_1$ (f) given by the following Expressions are retained.

$$c_0(f)=A(f)\cos(\theta(f))$$

$$c_1(f)=A(f)\sin(\theta(f)) \tag{5}$$

When the control frequency f(n) is provided and the cosine signal $x_0(n)$ and the sine signal $x_1(n)$ are input, the reference signal filter 3 generates the first reference signal $r_0(n)$ by multiplying the cosine signal $x_0(n)$ by the first reference filter coefficient $c_0$ (f(n)) corresponding to the control frequency f(n), and generates the second reference signal $r_1(n)$ by multiplying the sine signal $x_1(n)$ by the second reference filter coefficient $c_1$ (f(n)) corresponding to the control frequency f(n), and outputs them as the reference signal.

$$r_0(n)=c_0(f(n))x_0(n)$$

$$r_1(n)=c_1(f(n))x_1(n) \tag{6}$$

The filter coefficient update unit 4 updates the first control filter coefficient $w_0(n)$ and the second control filter coefficient $w_1(n)$ by the following Expression, for example, in accordance with the error signal e(n), first reference signal $r_0(n)$ and second reference signal $r_1(n)$.

$$w_0(n+1)=w_0(n)-\mu\cdot e(n)\cdot(c_0(f(n))x_0(n)-c_1(f(n))x_1(n))$$

$$w_1(n+1)=w_1(n)-\mu\cdot e(n)\cdot(c_1(f(n))x_0(n)+c_0(f(n))x_1(n)) \tag{7}$$

In Expression (7), μ is the update step provided from the update controller 7.

The secondary vibration/noise estimation unit 9 calculates and outputs the estimated secondary vibration/noise signal z'(n), which is the estimation signal of the secondary vibration/noise z(n) passing from the output device 200 to the detector 300 via the secondary path 500, from the first control filter coefficient $w_0(n)$ and second control filter coefficient $w_1(n)$, and from the first reference filter coefficient $c_0$ (f(n)) and second reference filter coefficient $c_1$ (f(n)) based on the control frequency f(n).

$$z'(n)=z'_{i0}(n)x_0(n)+z'_{i1}(n)x_1(n) \tag{8}$$

Here, $z'_{i0}(n)$ and $z'_{i1}(n)$ are calculated by the following Expressions.

$$z'_{i0}(n)=w_0(n)c_0(f(n))+w_1(n)c_1(f(n))$$

$$z'_{i1}(n)=w_1(n)c_0(f(n))-w_0(n)c_1(f(n)) \quad (9)$$

As described above, the secondary vibration/noise estimation unit 9 of the embodiment 2 can calculate the estimated secondary vibration/noise signal z'(n) with simple calculation given by Expressions (8) and (9).

To calculate the estimated secondary vibration/noise signal z'(n) by the method of the embodiment 1, the reference filter coefficients $c_0$ (f(n)) and $c_1$ (f(n)) of the embodiment 2 cannot be used as the filter coefficients for carrying out the filter processing of the control signal d(n), and hence a filter coefficient sequence obtained from the impulse response of the secondary path or the like must be prepared separately. In this case, not only an amount of calculation for the convolution between the control signal d(n) and the filter coefficient sequence, but also a memory for retaining the filter coefficient sequence is necessary. On this point, the method of the embodiment 2 can reduce the amount of calculation and that of the memory as compared with the method of the embodiment 1.

As described above, according to the active vibration/noise control apparatus of the embodiment 2, it is configured in such a manner that the secondary vibration/noise estimation unit outputs the estimated secondary vibration/noise signal not in response to the control signal, but in accordance with the characteristics of the control signal filter and the characteristics of the reference signal filter which has the transfer characteristics of the secondary path, through which the secondary vibration/noise is propagated, and which carries out the filter processing of the sound source signal. Accordingly, it has an advantage of being able to reduce the amount of calculation and the amount of memory.

Embodiment 3

To suppress the vibration/noise in a wide range, there are some cases where the active noise control apparatus is provided with a plurality of output devices and detectors. The embodiment 3 is an example of such an active vibration/noise control apparatus.

Figure 3:
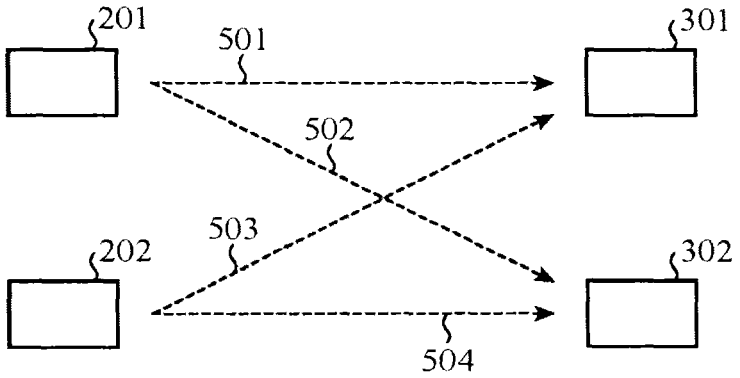
FIG. 3 is a diagram illustrating a plurality of output devices, a plurality of detectors and secondary paths in an active vibration/noise control apparatus of an embodiment 3 in accordance with the present invention 3.

Referring to the drawing, the present embodiment 3 in accordance with the present invention will be described. FIG. 3 is a diagram showing a configuration of the output devices and detectors and secondary paths connecting between them of the active vibration/noise control apparatus of the embodiment 3. Incidentally, since the configuration of the active vibration/noise control apparatus itself is the same as that of FIG. 1 or FIG. 2 in the drawing, the description will be made using the components in these drawings.

In FIG. 3, there are provided two output devices, a first output device 201 and a second output device 202; and two detectors, a first detector 301 and a second detector 302. The first secondary path 501 is provided between the first output device 201 and the first detector 301; the second secondary path 502 is provided between the first output device 201 and the second detector 302; the third secondary path 503 is provided between the second output device 202 and the first detector 301; and the fourth secondary path 504 is provided between the second output device 202 and the second detector 302. Incidentally, in such a configuration, the control signal filter 2 outputs a plurality of control signals corresponding to the first output device 201 and second output device 202; and the filter coefficient update unit 4 and the disturbance detector 6 receive the error signals detected by the first detector 301 and second detector 302.

In this case, the secondary vibration/noise estimation unit 5 (or 9) of the embodiment 3 calculates the estimated secondary vibration/noise signals for all the secondary paths described above. More specifically, using the reference filter coefficient sequences corresponding to the individual secondary paths, it calculates and outputs a first estimated secondary vibration/noise signal $z_1'(n)$ which is the estimation of the vibration/noise passing through the first secondary path 501; a second estimated secondary vibration/noise signal $z_2'(n)$ which is the estimation of the vibration/noise passing through the second secondary path 502; a third estimated secondary vibration/noise signal $z_3'(n)$ which is the estimation of the vibration/noise passing through the third secondary path 503; and a fourth estimated secondary vibration/noise signal $z_4'(n)$ which is the estimation of the vibration/noise passing through the fourth secondary path 504. If there is one whose gain is zero among the foregoing secondary paths, the calculation of the estimated secondary vibration/noise of the secondary path can be omitted.

The disturbance detector 6 detects, for the error signals input from the individual detectors, the disturbance from the addition results of the estimated secondary vibration/noise signals corresponding to the error signals and from the error signals. In the example of FIG. 3, since the first detector 301 associated with the first error signal $e_1(n)$ receives the secondary vibration/noise signals passing through the first secondary path 501 and the third secondary path 503, the disturbance detector 6 detects the disturbance of the first error signal $e_1(n)$ from the resultant signal of adding the first estimated secondary vibration/noise signal $z_1'(n)$ and the third estimated secondary vibration/noise signal $z_3'(n)$.

Likewise, since the second detector 302 associated with the first error signal $e_2(n)$ receives the secondary vibration/noise signals passing through the second secondary path 502 and the fourth secondary path 504, the disturbance detector 6 detects the disturbance of the second error signal $e_2(n)$ from the resultant signal of adding the second estimated secondary vibration/noise signal $z_2'(n)$ and the fourth estimated secondary vibration/noise signal $z_4'(n)$.

According to the disturbance detection results corresponding to the first error signal $e_1(n)$ and the second error signal $e_2(n)$, respectively, the update controller 7 reduces the update step of the filter coefficient update unit 4 corresponding to the error signal as to which the influential disturbance is detected.

As described above, according to the active vibration/noise control apparatus of the embodiment 3, there is provided an active vibration/noise control apparatus in which the control signal filter outputs a plurality of control signals; the filter coefficient update unit updates the coefficients of the control signal filter in response to a plurality of error signals; and the disturbance detector outputs the disturbance detection results for the individual error signals, respectively, wherein the secondary vibration/noise estimation unit, for all the combinations of the plurality of control signals and the plurality of error signals having cause-and-effect relationships, outputs the estimated secondary vibration/noise signals in accordance with the secondary paths associated with the individual combinations; and the disturbance detector outputs for the individual error signals the disturbance detection results concerning the error signals in response to the signals resulting from adding the estimated secondary vibration/noise signals corresponding to the individual error signals. Accordingly, the present embodiment 3 offers an advantage of being able to prevent the erroneous detection of the disturbance even when the residual vibration/noise increases temporarily owing to the erroneous adaptation or the like and to achieve the stable vibration/noise reduction effect even in the active vibration/noise control apparatus with a plurality of output devices and detectors.

In addition, according to the active vibration/noise control apparatus of the embodiment 3, since the update controller adjusts the update step of the filter coefficient update unit corresponding to the error signals as to which the disturbance is detected, it can continue the adaptive operation for the error signal as to which the disturbance is not detected, thereby offering an advantage of being able to stabilize the suppression effect of the vibration/noise.

Incidentally, it is to be understood that a free combination of the individual embodiments, variations of any components of the individual embodiments or removal of any components of the individual embodiments is possible within the scope of the present invention.

INDUSTRIAL APPLICABILITY

As described above, an active vibration/noise control apparatus in accordance with the present invention is an apparatus that can reduce the vibration or noise produced by machinery, for example, by generating the cancellation vibration or noise, and is suitable for an application for reducing the vibration or noise of the engine of a car, for example.

DESCRIPTION OF REFERENCE SYMBOLS

1 sound source signal generator; 2 control signal filter; 3 reference signal filter; 4 filter coefficient update unit; 5, 9 secondary vibration/noise estimation unit; 6 disturbance detector; 7 update controller; 100, 100*a* active vibration/noise control apparatus; 200 output device; 201 first output device; 202 second output device; 300 detector; 301 first detector; 302 second detector; 400 vibration/noise source; 500 secondary path; 501 first secondary path; 502 second secondary path; 503 third secondary path; 504 fourth secondary path; 600 disturbance source.

What is claimed is:

1. An active vibration/noise control apparatus comprising:

a control signal filter that receives a sound source signal determined by control frequency specified in accordance with a vibration/noise source which produces vibration/noise, and that outputs a control signal;

a filter coefficient updater that updates coefficients of the control signal filter in response to an error signal and the sound source signal, the error signal resulting from interference of the vibration/noise with secondary vibration/noise generated from the control signal;

a secondary vibration/noise estimator that outputs an estimated secondary vibration/noise signal in response to the control signal;

a disturbance detector that outputs a disturbance detection result in response to the error signal and the estimated secondary vibration/noise signal; and an update controller that adjusts an update step of the filter coefficient updater in response to the disturbance detection result.

2. The active vibration/noise control apparatus according to claim 1, wherein the secondary vibration/noise estimator outputs the estimated secondary vibration/noise signal by processing the control signal through a filter with transfer characteristics of a secondary path through which the secondary vibration/noise is propagated.

3. The active vibration/noise control apparatus according to claim 1, wherein the disturbance detector outputs the disturbance detection result in response to an estimated original detection signal obtained by subtracting the estimated secondary vibration/noise from the error signal.

4. The active vibration/noise control apparatus according to claim 1, wherein the secondary vibration/noise estimator outputs the estimated secondary vibration/noise signal, not in response to the control signal, but in accordance with characteristics of the control signal filter and characteristics of a reference signal filter that has transfer characteristics of a secondary path through which the secondary vibration/noise is propagated and that carries out filter processing of the sound source signal.

5. The active vibration/noise control apparatus according to claim 1, wherein the control signal filter outputs a plurality of control signals;

the filter coefficient updater updates the coefficients of the control signal filter in response to a plurality of error signals; and the disturbance detector outputs disturbance detection results for the individual error signals, respectively, and wherein the secondary vibration/noise estimator, for all combinations of the plurality of control signals and the plurality of error signals having cause-and-effect relationships, outputs estimated secondary vibration/noise signals in accordance with secondary paths which are associated with the individual combinations and through which the secondary vibration/noise is propagated; and the disturbance detector outputs for the individual error signals the disturbance detection results concerning the error signals in response to signals resulting from adding the estimated secondary vibration/noise signals corresponding to the individual error signals.

6. The active vibration/noise control apparatus according to claim 5, wherein the update controller adjusts the update step of the filter coefficient updater corresponding to the error signals as to which the disturbance is detected in a manner as to reduce the update step.

* * * * *